United States Patent [19]

Dubeta

[11] Patent Number: 4,805,897

[45] Date of Patent: Feb. 21, 1989

[54] WATER SLIDE SYSTEMS

[76] Inventor: David J. Dubeta, P.O. Box 539, Sylvan Lake, Alberta, Canada, T0M 1Z0

[21] Appl. No.: 52,067

[22] Filed: May 21, 1987

[51] Int. Cl.[4] ..... A63G 21/18

[52] U.S. Cl. ..... 272/56.5 R; 272/1 B; 104/70

[58] Field of Search ..... 272/56.5 R, 56.5 SS, 272/1 B, 32; 104/69, 70, 72, 73, 56, 57, 63, 64, 67, 134, 135, 136; 193/2 A, 2 E, 12, 13, 27, 28, 33, 38; 405/119, 121, 126, 120, 80, 87, 88, 94, 95; 251/12, 65, 68–74

[56] References Cited

U.S. PATENT DOCUMENTS

| | | | |
|---|---|---|---|
| 776,936 | 6/1904 | Pusterla | 104/73 |
| 1,648,196 | 11/1927 | Rohmer | 104/70 |
| 4,145,042 | 3/1979 | Becker et al. | 272/56.5 R |
| 4,149,710 | 4/1979 | Rouchard | 272/56.5 R |
| 4,194,733 | 3/1980 | Whitehouse, Jr. | 272/56.5 R |

*Primary Examiner*—David A. Scherbel
*Assistant Examiner*—Richard E. Chilcot, Jr.

[57] ABSTRACT

Apparatus for connecting amusement water slides from continuous water flow down the slide to controlled, spaced apart gushes of water enhancing the thrill of the ride and improving the safety thereof. The slide run has a start position at the upper elevated end from a platform and an exit lower end that discharges the rider and water into a landing pool. At least one of the multiple runs is provided with apparatus of the foregoing for having intermittent gushes of water along such run as desired by operator or rider. A vertical tower with stairs and/or elevator provides for movement of the participants from the lower end of the runs to the upper start end of the runs. A water reservoir is provided at some location upstream from the end of the slide run (preferrably at the uppermost end, i.e. the start of the run), and water is pumped from the landing pool into the reservoir which, when full, overflows into the water chute slide.

21 Claims, 9 Drawing Sheets

WATER SLIDE SYSTEMS

FIELD OF INVENTION

This invention relates to improvements in water slide systems.

BACKGROUND OF INVENTION

Water slides for amusement purposes are well known and typically have straight and/or curved slide runs with entry thereto from a platform at an upper end and discharge from the opposite end at a lower elevation into a pool. Water is pumped, normally from the pool, to the upper end of the slide and runs conventionally in a continuous manner down the slide providing a slip surface for the occupant. U.S. Pat. Nos. 4,145,042, issued Mar. 20, 1979 to K. Becker, and 4,194,733, issued Mar. 25, 1980 to B. Whitehouse disclose a single helical run from an elevated platform to a pool of water at the bottom.

U.S. Pat. No. 4,196,900, issued Apr. 8, 1980 to K. Becker, discloses a system of multiple runs from a platform or platforms at the upper end into a common landing pool at the bottom. This system substantially increases the capacity without a corresponding increase in the area occupied by the system.

One object of the present invention is to provide an improved design which further minimizes the area occupied by the system and maximizes the capacity of the slide.

In the foregoing patented systems as well as others, water is continuously recirculated and runs down the slide at a constant flow rate. In the foregoing U.S. Pat. No. 4,196,900 it has been suggested the water supply system may include thrust nozzles at the top of the slide giving an extra push component to a person so that once boarded on the slide such person does not block the slide by remaining in place. This extra thrust at the beginning of the ride, however, does not in any way ensure the rider will continue without stopping for some reason or other before reaching the end of the run.

Should one rider on the run travel at a slower rate than another rider upstream therefrom, the latter can run into the former and one or the other can get hurt, and sometimes severely. Because of this possibility of mishap along the run, some operators prevent one from commencing the ride at the upper end until such time as the earlier rider has reached the pool at the bottom. While this increases the safety of the run, it severely limits the capacity.

If a number of riders travel in sequence one after the other down the same run and even though they are allowed to go at spaced intervals, the various riders will travel at different speeds relative to one another. For example, an inexperienced or novice rider may be substantially slower or purposely, through fright, slow themselves down by sitting up and/or holding on to the sides of the run. There are a number of factors which will cause one rider to travel at a different rate than another. The present applicant, in one of his installations, has timed riders down one of the 400′ runs and the fastest rider completed the run in 16 seconds. Obviously, at this velocity, considerable injury can be encountered by that rider running into one who may have stopped himself on the run or is travelling at a substantially slower speed.

A principle object of the present invention is to provide modifications in the water supply system for and in a water slide which not only gives the occupants a more thrilling ride but also increases substantially the safety thereof.

A further principle object of the present invention is to maximize the capacity of a water slide run by allowing a number of riders to use the same run and reduce the likelihood of injury through preventing or minimizing the occurence in which one rider will bump into another rider downstream therefrom and travelling at a slower rate.

A still further principle object of the present invention is to controllably maintain a spacing between multiple riders using the same water slide at the same time.

Another means of increasing the capacity of a water slide is disclosed in U.S. Pat. No. 4,194,733. The patentee proposes two separate starting positions for one slide and a valving arrangement where the water can run continuously and be selectively directed to one or the other of the slide start positions. While this may be useful in loading a slide to capacity, there is no provision or suggestion for maintaining a spacing between several riders using the same run at the same time.

SUMMARY OF INVENTION

In accordance with one aspect of the present invention there is provided a multiple run water amusement slide wherein each run has at least two helical portions each of which has more than one turn about the center thereof and joined by runs that horizontally separate one helical portion from that of another, and wherein the helical portions of one run are interleaved with the helical portions of another run to thereby occupy minimum ground area, each of said runs having a start position at the upper end from an elevated platform and an exit lower end with all runs discharging at the lower end into the same landing pool and a vertical tower for movement of the participants of the slide up to the platform at the start end of the runs.

In accordance with the principal aspect of the present invention, there is provided an improvement in and for a water slide recreational installation of the type that includes a water chute slide for the participants, an elevated platform at the beginning of the slide, a landing pool at the bottom of the slide and water flow down the slide for the occupants thereof the improvement comprising a water reservoir at some location upstream from the lower end of the slide (preferrably at the beginning of the run), means for directing at least a selected portion of the water delivered to the top end of the slide into said reservoir, and a valved outlet from said reservoir discharging into said chute for releasing selected quantities of water at spaced intervals into said chute to provide intermittent gushes of water that rush in sequence one after the other down said slide.

The release of a gush of water from the reservoir may be triggred by movement of an occupant on the slide moving past a sensor. With the release of a gush of water the rider is carried by the same along the run and at some interval later another gush is released in response to another rider passing the sensor. The spaced gushes of water maintain the multiple occupants of the run spaced from one another so that the same run can be used by several riders at the same time without any or substantially any danger of one rider running into another. Alternatively, the release of the gush of water may be operator and/or participant controlled and if desired the quantity of water released may be automatically controlled by a characteristic of the slide participant, for example, the participants's weight.

LIST OF DRAWINGS

The invention is illustrated by way of example with reference to the accompanying drawings, wherein.

DESCRIPTION OF PREFERRED EMBODIMENT

Figure 1:
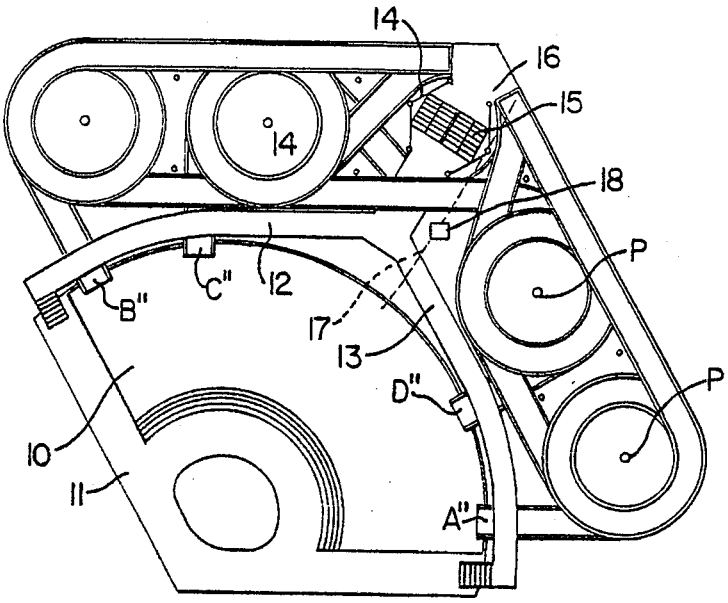
FIG. 1 is a top plan diagrammatic view of a multiple run water slide system.

Referring to the drawings, FIGS. 1 to 4 illustrate, in top plan view, a multiple run water slide for amusement purposes. Illustrated are four runs designated A, B, C and D having respective start ends A', B', C' and D' at an elevated position and respective terminal ends A", B", C" and D" discharging into the same landing pool 10 at different locations.

Each slide is made up of a plurality of channel sections of suitable material, for example metal, resin impregnated glass fibre or the like, and are joined by appropriate water-tight seals in end-to-end relation. The runs are supported by a superstructure which includes a plurality of posts shown as circles in FIGS. 1 to 4 some of which are identified by the letter P.

Each run has two helical portions, for example run A has respective helical portions H1 and H2 which are horizontally spaced from one another and the run is completed by straight and/or curved sections designated S. Each helical portion is one complete turn or more and is an open helix whereby the helical portion of one run is interleaved with the helical portion of another run, for example helical portions H1 and H2 of run A are interleaved with respective helical portions H3 of run B and H4 of run D. Helical portion H5 of run B is interleaved with helical portion H6 of run D. Helical portions H7 and H8 of run C are not interleaved with helical portions of other runs but are interleaved with different sections of the other runs.

The pool 10 is partially surrounded by a deck 11 for the participants and from the deck there are two ramps designated respectively 12 and 13 that lead therefrom to a tower 14 in which there are stairs 15 leading to the upper end of the runs. The stairs, obviously could be replaced by an elevator, escalator or the like if so desired. At the top of the stairs there is a platform or landing where the participants line up one after the other for the start position of the respective different runs.

In the slide system of FIGS. 1 to 4 there are two platforms designated respectively P1 and P2, one of which is at a higher elevation than the other. Platform P1 is at the start of runs A and B and is above platform P2 which is at the beginning of runs C and D. Water from the pool 10 (see FIG. 1) is pumped via pipeline 17 and pump unit 18 to the upper end of the runs to maintain a continuous constant flow of water down the runs. With only one water supply line 17, as shown in the drawings, there would be four different outlets at the upper end, i.e. one for each of the four different runs, but, obviously, a separate pumping system could be provided for each of the runs. The rate of water flow can be controlled by varying the pumping rate and/or the use of flow control valves in recirculating the water from the pool to the upper part of the run.

The foregoing water slide system is compact providing large flume footage within a small land area. In one of applicant's designs the four runs vary in length from 100.6 m to 121.6 m and can be located on a space 25.9 m wide×33.5 m long including the landing pool. Such installation has 427 m of slide on less than 929 $m^2$ of space and in actual operation has a proven capability of 2,000 rides per hour.

While the foregoing system provides a pleasurable and exciting ride for participants and maximizes utilization of space, a still more thrilling and also safer ride has been found by the applicant in another and principal aspect of the invention. This further aspect is applicable to the slide system of FIGS. 1 to 4 or to any existing or to any new installation of an amusement waterslide system and the improvement comprises releasing gushes of selected quantities of water at spaced intervals down the run. This can be provided for any one or all of the runs of the foregoing system or in any other installation where there may be, for example, only one run. In the slide system of FIGS. 1 to 4 and if only one or two slides incorporate the present improvement, it preferrably involves runs C or D since they then become just as or perhaps even more attractive than the longer runs A and B which have the higher start point. Basically, the improvement comprises a water reservoir at some location upstream from the end of the run, preferrably at the upper end, into which the recirculated water (or at least a major portion thereof) is pumped and released therefrom at intervals providing gushes that run down the slide in timed spaced apart relation co-related with the frequency of use by the slide riders. When the reservoir is full it overflows into the slide run. Water from the reservoir is released into the slide in one instance through a pressure actuated valve activated by detection of movement of an occupant on the slide downstream from the start position.

In the prior state of art, the water slide flumes are operated using water supplied to the top of the ride on a constant flow basis pumped at a rate of 800 to 1,000 gallons/min., and thereafter allowed to run down the flume at the same constant flow rate. For each rider (assuming an average 900 gallons/min. flow rate) approximately 150 gallons of water is used yet the rider is sliding on only roughly 15 gallons of water at any particular instance throughout the duration of the ride. The balance of the water is, in effect, wasted. In the present system as proposed by the applicant this effectively wasted water is stored in the reservoir and released (all or at least in part) with each rider. Instead of the rider of the slide riding on 15 gallons of water, the rider is in effect utilizing all of the water, i.e. up to 150 gallons or equivalent depending upon the storage capacity of the reservoir. The storage of the water and release therefrom into the slide at spaced intervals effectively provides a series of floods which travel one after the other down the slide at the sam rate of timing as the use of the slide by the occupants.

An arrangement of the intermittent flood aspect of the invention is illustrated in FIGS. 6 to 12, and some modifications thereto are shown in FIGS. 15 to 18. Referring to FIGS. 6 to 12 there is illustrated, for example at the start of run A, a reservoir unit that includes a vertical cylindrical tube 30 mounted on and projecting upwardly from a base or casing 40 having a water confining chamber 41 with a discharge opening in an end wall 46. Release of water is controlled by a pressure actuated valve 50 and is discharged into the beginning of the run. After some experience of testing a prototype it was decided to use a reservoir in the form of a 20" diameter, clear, resin glass fiber tube 7' in height and open at the top for overflow of water.

Figure 6:
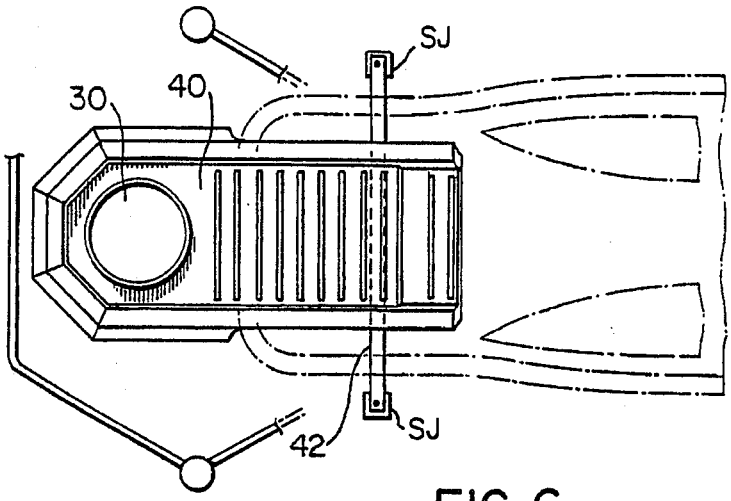
FIG. 6 is a partial top plan view of a water reservoir and discharge system, provided in accordance with the present invention, at the upper end of one of the slide runs.
Figure 7:
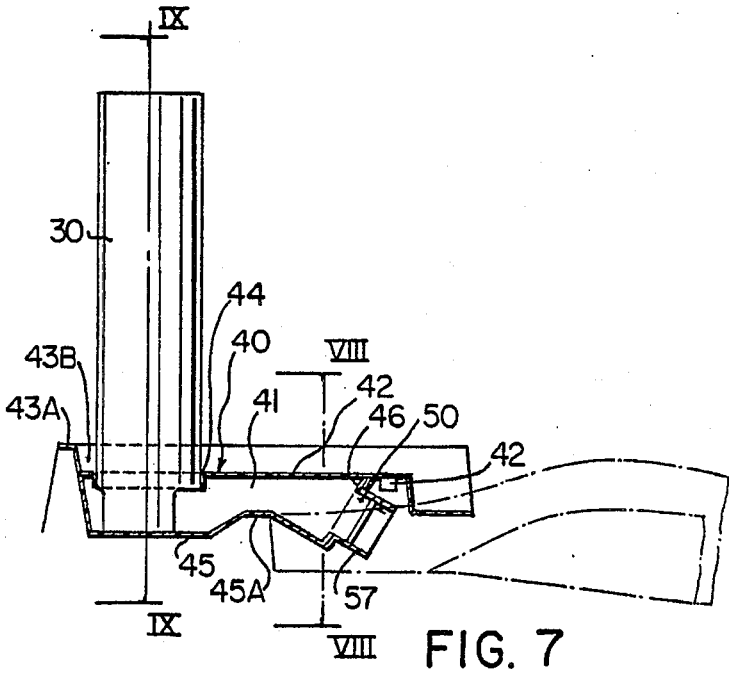
FIG. 7 is a side elevational view, in partial section of the water storage and spillway arrangement of FIG. 6.

The casing 40, with the water reservoir 30 mounted thereon, is supported on the platform at the upper end of a slide run and a steel support leveller 42 engages an underside portion of the discharge casing. This support is adjustable by suitable screw jack means SJ whereby final adjustment in levelling the discharge casing and positioning the reservoir vertically can be readily accomplished. The jacks SJ can be under one o both feet (as shown in FIG. 6) of the cross bar 42 or between the cross bar 42 and the casings 40 (see FIG. 18).

Figure 8:
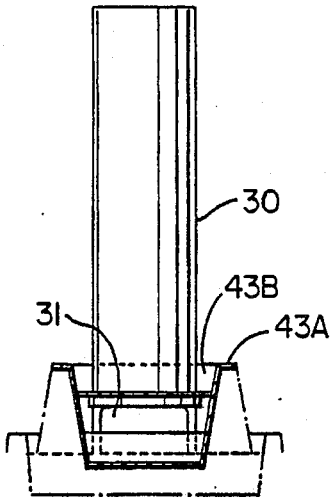
FIG. 8 is a sectional view taken along line 8—8 of FIG. 7.
Figure 9:
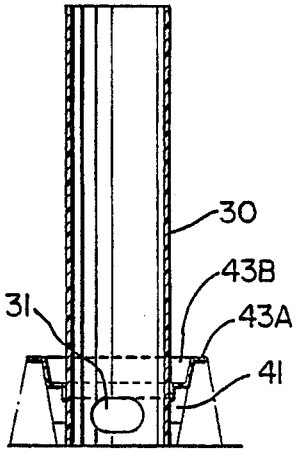
FIG. 9 is a sectional view taken along line 9—9 of FIG. 7.
Figure 10:
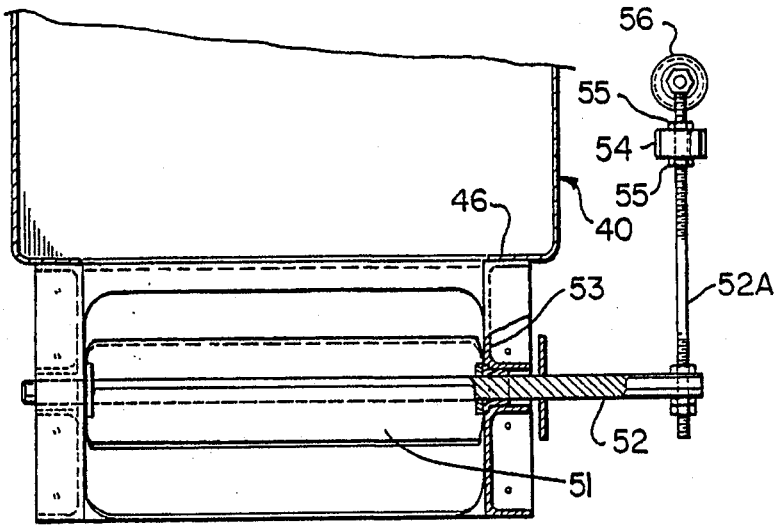
FIG. 10 is a partial top plan sectional view showing details of the valve for the water reservoir.
Figure 11:
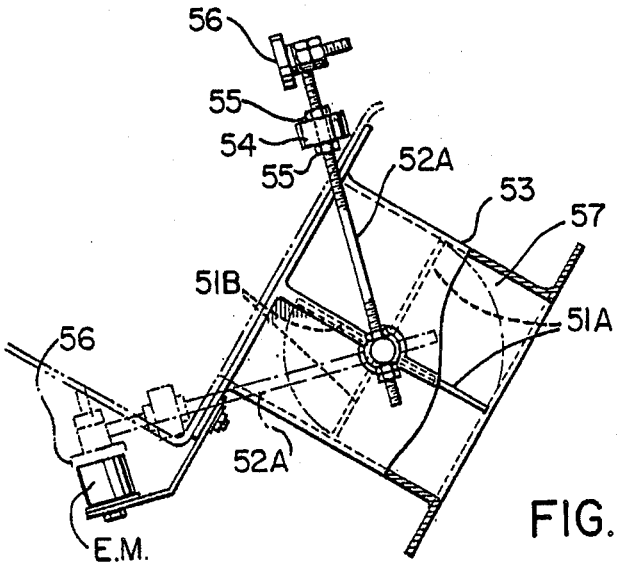
FIG. 11 is a side view of the valve of FIG. 10 and activator mechanism therefor.

The top of the casing 40 has a flat upper surface 43 (sloping slightly toward the slide run) with a ledge 43A projecting upwardly on three sides thereof providing a channel 43B for directing overflow water into the slide channel. The cylindrical reservoir 30 projects through an aperture 44 in the top wall of the casing 40 and is either supported on a ledge forming part of the top wall of the chamber or, alternatively, extends downwardly and rests on the bottom or floor 45 of the chamber in which case the cylindrical reservoir has an opening in the lower sidewall portion thereof as illustrated in FIG. 8 and designated 31. The reservoir and casing have a water tight joint therebetween but this is not absolutely essential as some seepage of water can be tolerated since it will flow over the top of the tank into the slide flume.

The bottom wall 45 of the discharge chamber has an upwardly projecting portion 45A with the valve 50 located downstream therefrom, the opening to the valve being through the end wall 46 of the casing, which is disposed at an acute angle to the vertical.

The valve assembly 50 is a flap-type valve which includes a plate 51 secured to a shaft 52 pivotally mounted by suitable bushings or journals on opposed walls of a valve housing 53 detachably secured to the sloped end wall 46 of the discharge casing. The flap or plate 51 has the central longitudinal axis thereof offset slightly from the axis of the shaft 52. The plate, for example, may be 9" wide with portion designated 51A being 5" and portion 51B being 4". An arm 52A is secured to the shaft and carries a variable positionable counterweight balance 54 held in position by a pair of lock nuts 55 threaded on the arm 52A. An armature or plate 56 is mounted on the end of the arm and, in one position of the shaft, it engages an electromagnet EM wired to a remote sensor. With plate 56 engaging electromagnet EM flap 51 of the valve closes the water throughpassage 57, i.e. a valve closed position.

With the reservoir full of water and the discharge chamber full the flap valve is maintained in a closed position through the strength of the electromagnet as well as forces on the arm due to the weight of the arm and the counterweight 54 thereon. These forces counteract and overcome the water force on the valve resulting from the eccentricity of the valve plate 51 on the shaft 52.

Figure 2:
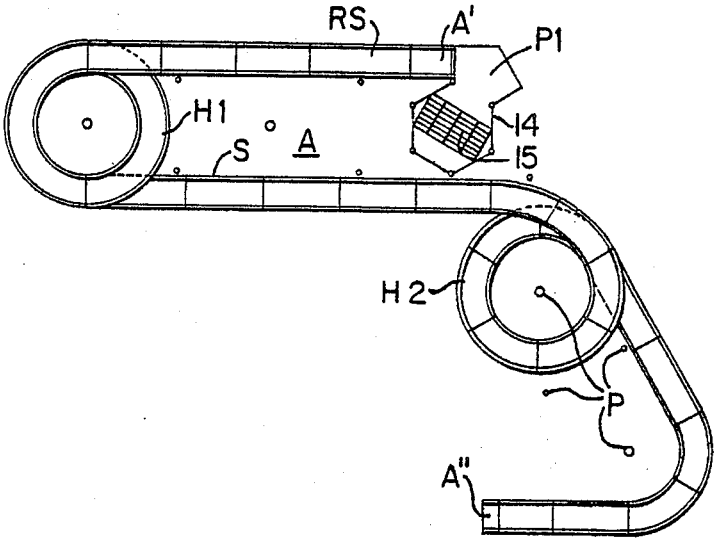
FIGS. 2, 3 and 4 are plan views of the four slide runs internested one within the other in the system illustrated in FIG. 1.
Figure 3:
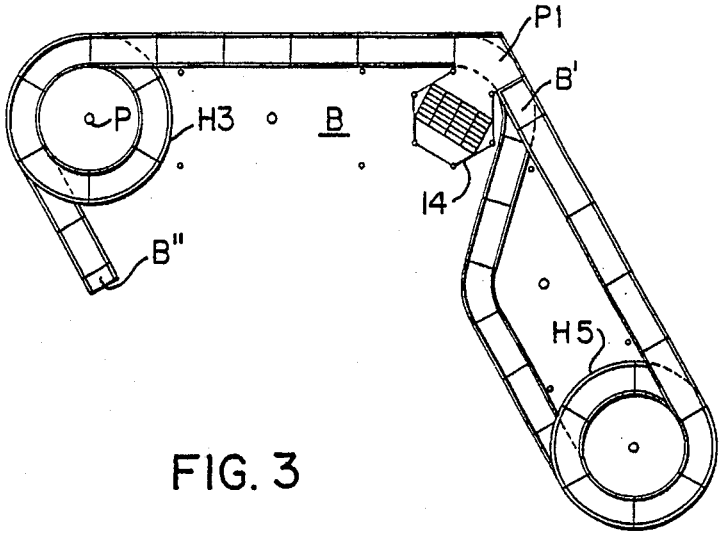
Figure 4:
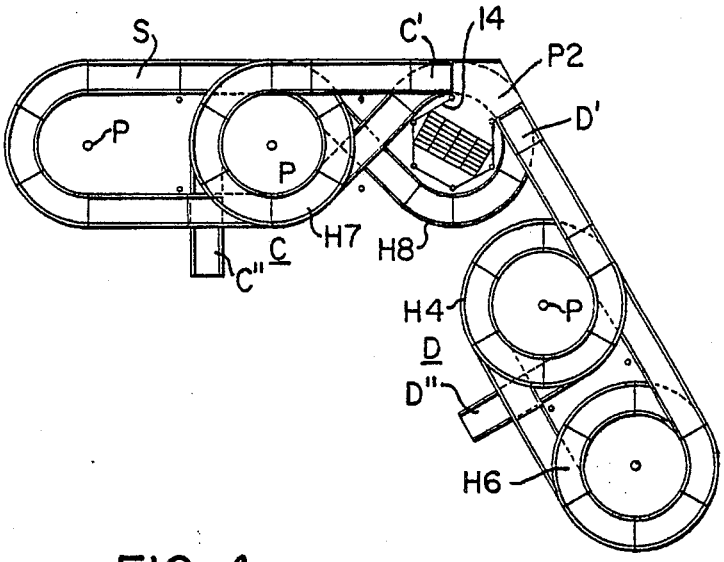
Figure 5:
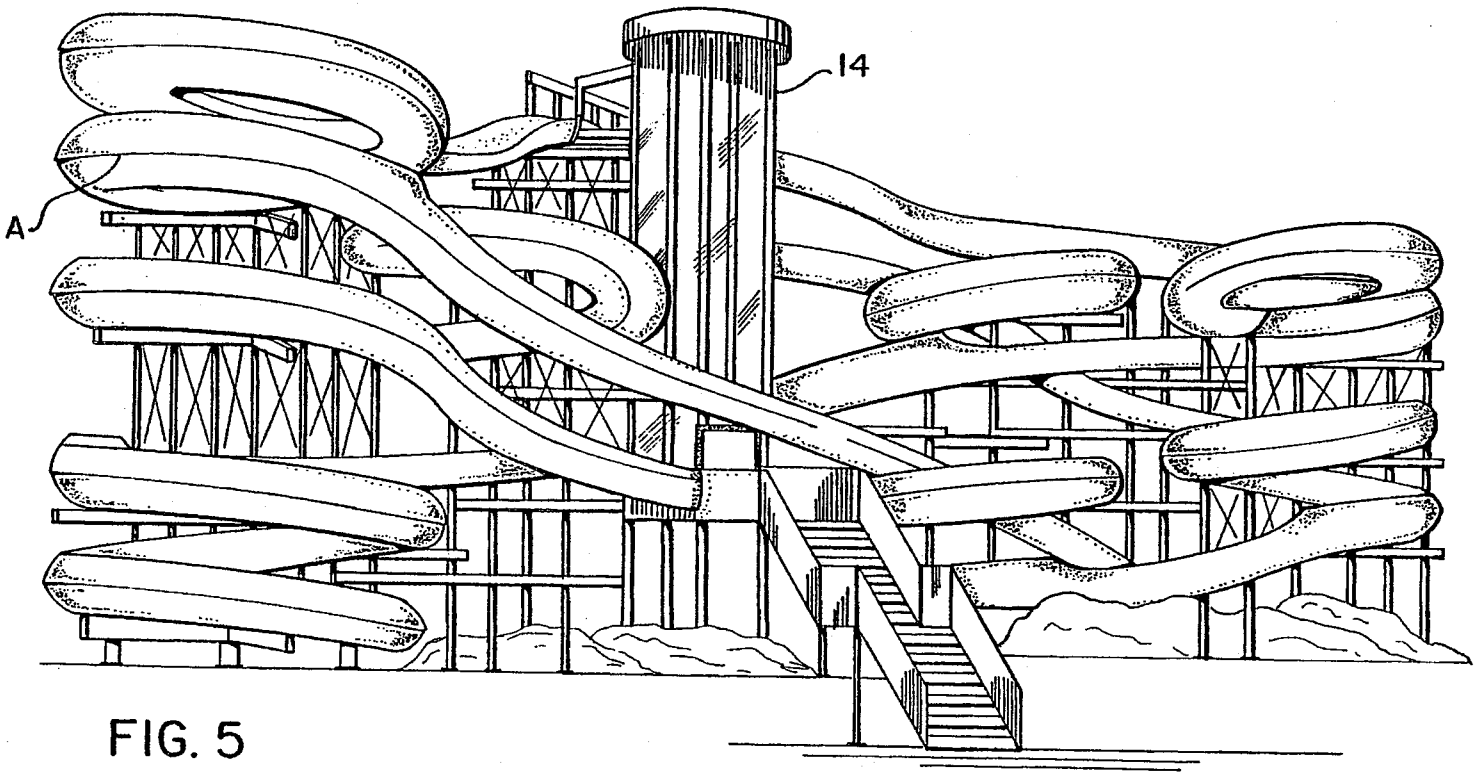
FIG. 5 is a diagrammatic perspective view of the water slide installation of FIG. 1.

The electromagnet EM is wired to a remote sensor RS located at some selected position downstream from the start of the slide and in FIG. 2 such sensor is diagrammatically illustrated downstream from the start A' of the run A. The remote sensor RS detects passage thereby of an occupant on the slide momentarily breaking the circuit of the electromagnet EM at which time the water force on the eccentrically mounted flap valve overcomes the weight of the restraining arm 52A and water from the reservoir is rapidly released in a gush through the valve and proceeds as such down the slide taking the occupant therewith. In the valve open position the valve plate portion 51A is downstream from portion 51B in the flow of water. The valve automatically closes by virtue of the forces of the counterbalanced arm below a selected water flow rate and is locked in the closed position by the force of the electromagnet during which time the reservoir refills in preparation for the next rider. With a water flow rate less than that required to have full flow in passage 57, quick closing of the valve results from water flow against valve plate 51B. If the water flow rate is such that it is below shaft 52 when the valve starts to close the entire water flow force acts only on valve plate portion 51B.

If so desired, a gate can be provided at the top of the slide that prevents access of a slide user until such time as the reservoir is filled with a selected quantity of water for release into the slide run. In such instance a suitable sensor could be used that would caus the gate to be unlocked only when that selected quantity has been reached. This, in combination with a selected fill rate of the reservoir can be used to space multi-users of a run at suitable safe minimum spacings on the slide. By "multi-users" it is meant there is more than one rider on the same slide run at the same time. Even without the proposed controlled gate feature the slide's safety is substantially increased over slide systems that use a constant flow rate of water down the slide because the flood occurs with each rider and the rider is carried thereby in a positive manner for the entire run of the slide. Because of this the riders on the slide are maintained at a spaced relation relative to one another on the slide as they proceed down the same. This overcomes many of the accidents that occur with the constant flow rate system as previously discussed.

Figure 12:
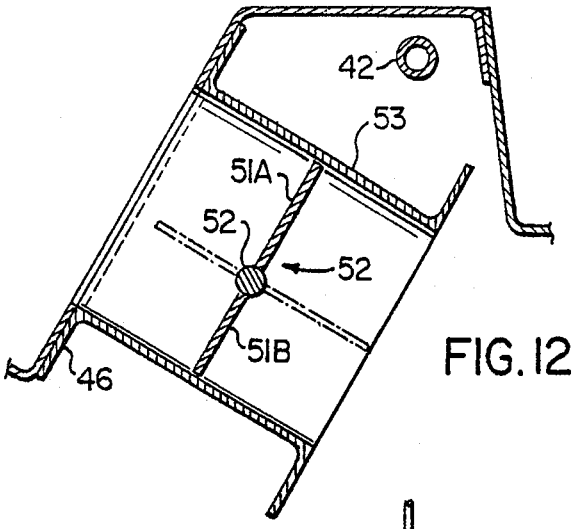
FIG. 12 is a sectional view showing details of the water control valve.
Figure 13:
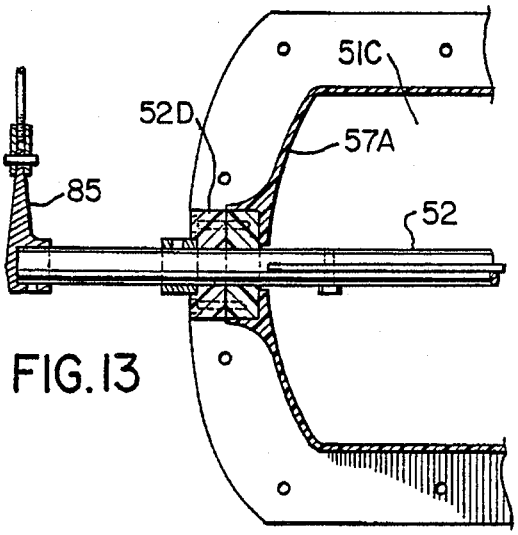
FIGS. 13 and 14 are similar to FIGS. 10 and 11 showing an alternate valve control mechanism.
Figure 14:
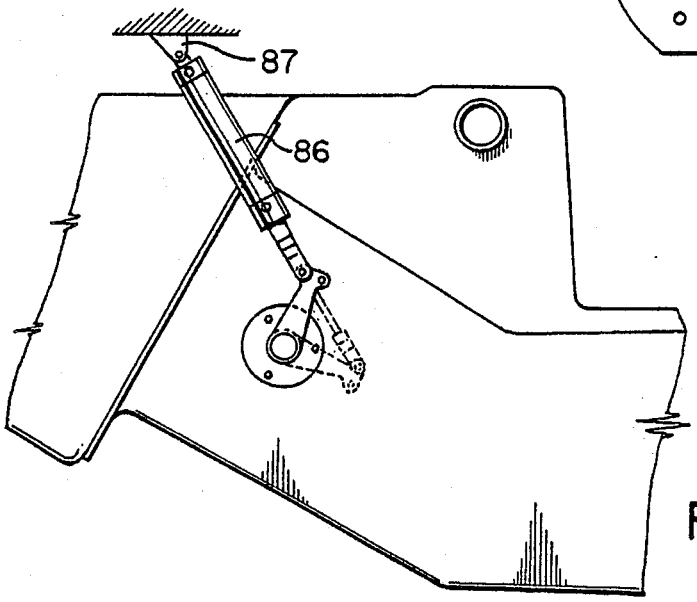
Figure 15:
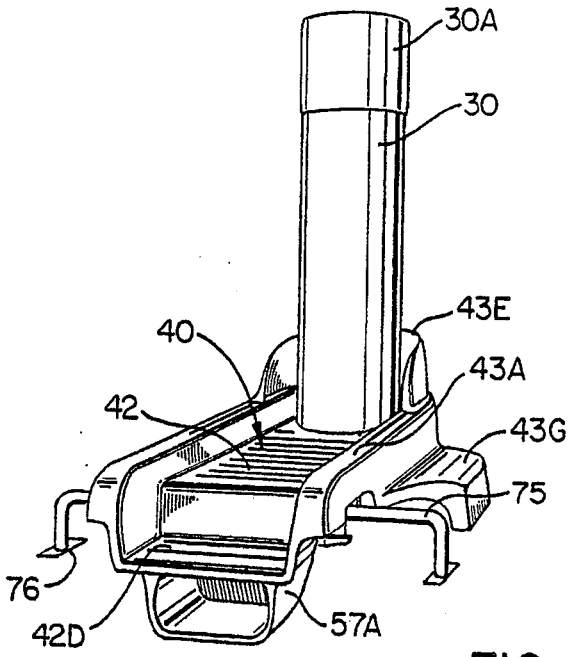
FIG. 15 is an oblique view of the water reservoir with a modified valve control.
Figure 16:
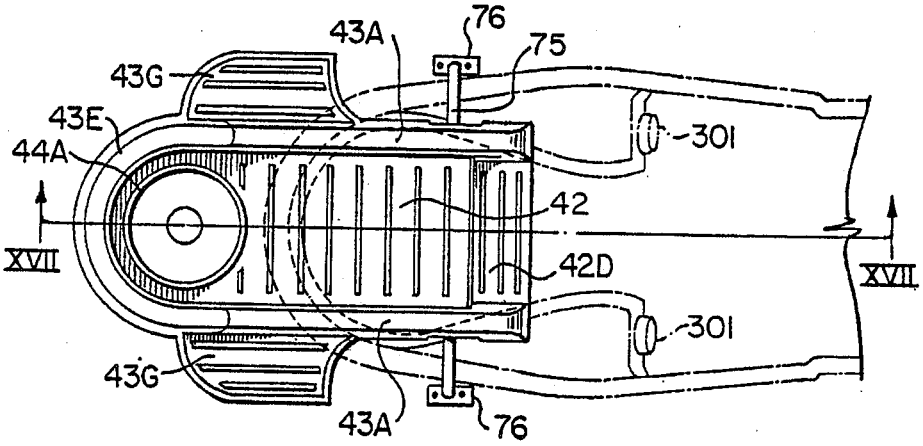
FIG. 16 is a top plan view of the device shown in FIG. 15 mounted at the start end of a slide run.

The apparatus illustrated in FIGS. 15 to 18 has been designed for commercial use and incorporates a few minor modifications and refinements over the previously described apparatus. Details of the valve actuating and mounting mechanism for this embodiment is illustrated in FIGS. 12 and 13, which is an alternative for the valve construction and actuation illustrated in FIGS. 10, 11 and 12.

Referring to FIGS. 15 to 18, there is illustrated a reservoir in the form of a cylindrical tube 30 having an overflow collar 30A mounted on the upper end thereof and at the opposite end rests upon a flanged recess 44A in the upper deck 42A of a discharge chamber housing. The housing is a molded fiberglass tank unit with an upwardly projecting ledge 43A extending around three sides and the fourth side has a step-down 42D. An overlow supply shroud 43E projects upwardly from the ledge 43A around the sides and the back of the cylindrical tube, and projecting laterally from opposite sides of the molded casing are steps 43G. The molded casing has a chamber 41A with an opening in an end wall 46A to which is attached a discharge spout. The discharge spout is the same essentially as in the previous embodiment, but has an extending portion 53A located below the step-down 42D, as clearly seen from FIGS. 15 and 17.

The front end of the discharge tank unit is carried by a generally U-shaped support pipe and leveller unit 42, which may have a jacking device under one or both ends thereof.

Figure 17:
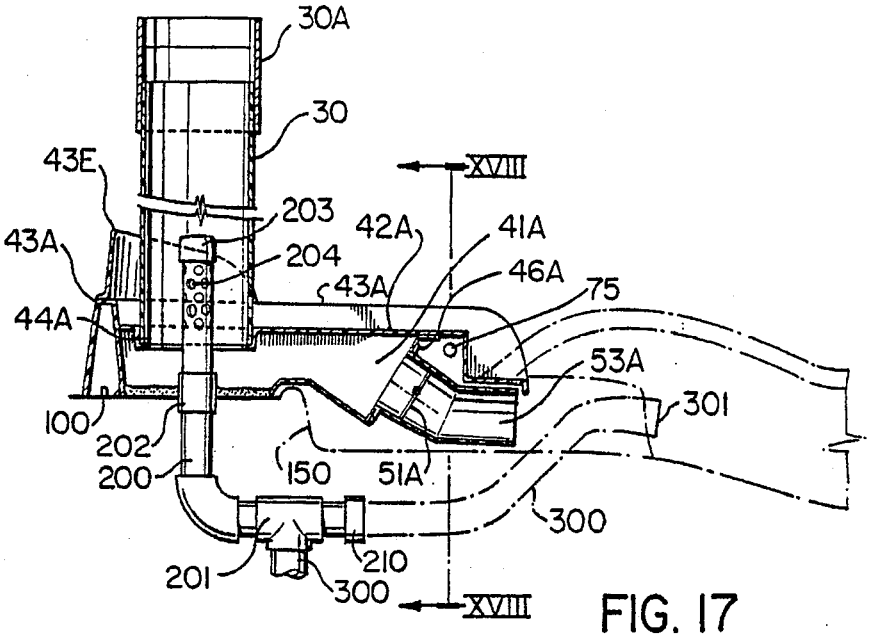
FIG. 17 is a sectional view taken along line 17—17 of FIG. 16.
Figure 18:
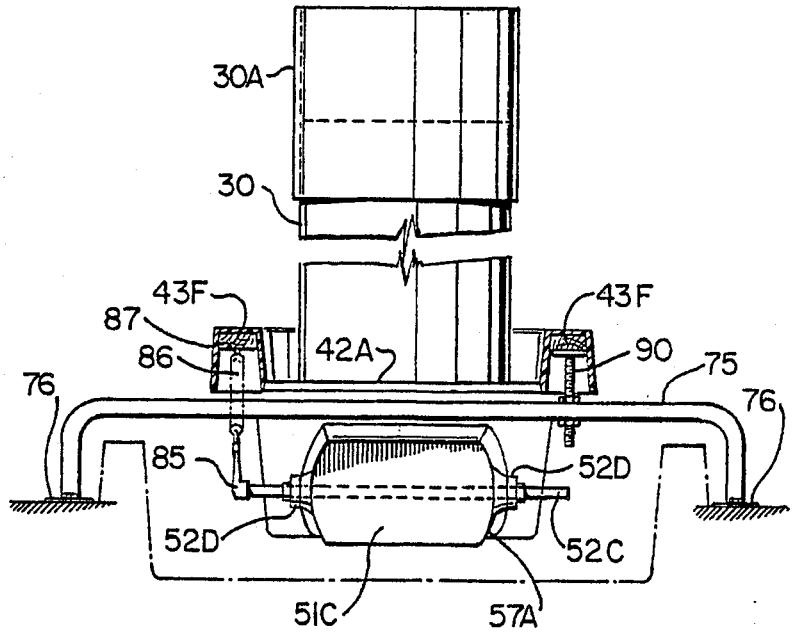
FIG. 18 is a sectional view taken along line 18—18 of FIG. 17.

The rear end of the tank unit rests upon the deck 100 at the top end of the slide, such top end or beginning part of the slide in FIG. 17 being designated by the reference numeral 150. From FIG. 18 it will be noted that the upwardly projecting portion 43A of the housing has a structural member in the form of a 2×4 or the like 43F. In this embodiment, a levelling jack in the form of a threaded bolt and nut unit has a top end thereof engaging the 2×4 43F and the other end anchored to the transfer portion of support pipe 42. The threaded rod, or bolt and nut unit, is identified by the reference numeral 90, and there may be one as illustrated in FIG. 18 at one side only, or alternatively there may be one at each of opposite sides of the deck portion 42A.

The discharge valve is in the form of a flat plate 51C mounted on a shaft 52C journaled for rotation in replaceable nylon bushings 52D in the side wall 57A of the valve casing. A bell crank 85 is attached to one end of the flap valve shaft 52C and is attached to one end of a hydraulic or air double acting cylinder unit 86, the other end of which is anchored as at 87 to one of the casing support members 43F. The bell crank arm 85 may be located at either end of the shaft 52C.

In the embodiment illustrated in FIG. 17, the supply water is directed to the tube reservoir by way of branch pipeline 200 connected by a T-unit 201 to the existing slide water supply line 300 that has an outlet port 301 in a conventional manner located at the upper end of the slide section. The branch line 200 projects upwardly through the landing deck 100 at the top end of the slide and through the bottom wall of the casing which is provided with a coupling 202. The pipe 200 projects upwardly through the coupling, which provides a water tight seal and projects into the lower end of the casing. It is closed at the top end by a cap 203. An end portion of the pipe 200 projecting into the cylindrical reservoir is perforated, i.e. has a plurality of apertures 204. The water supply line 300 in addition to the T-coupling 201 is provided with a balancing valve 210. The balancing valve is located downstream from the T which allows control as to the amount of water to be diverted to the reservoir. Any excess flow may be allowed to disperse down the flume through the existing flume supply ports.

In the foregoing described unit the overflow collar contains the overflow water tight to the 20 inch diameter tube and is of sufficient height as to contain any additional build-up of head as the overflow condition is reached and maintained. The splash shroud is more or less cosmetic, and has been incorporated to prevent water from splashing over the sides of the unit when overflowing. The discharge spout from the casing channels the water to the rider start position. It is fabricated from the same mold as used for the valve housing, or is separately formed and detachably secured to the housing. The inlet piping can be brought into the unit from the underside as indicated, or above deck level into the side or the rear of the discharge chamber.

The valve can be, in its simplest form operated by the attendant whom, through experience, can release the quantity of water appropriate for the size, weight and experience of the rider. While the previously described remote sensor is operative, there are a few other considerations to be taken into account, one of which involves dispensing an amount of water dependent upon the size and weight of the rider. With the remote sensor there is no way of detecting this unless extremely sophistocated sensors are utilized, which can of course be done, and through computerized control release an amount of water precisely co-related to the occupant's weight and size.

The valve flaps are symmetrical about the axis of the shaft in this embodiment, and thus the pressure differential on the flap is not relied upon to open the valve. Also, it will be observed that there is no counterbalancing and the air cylinder is double acting. Air pressure is supplied by way of a suitable source and control is by way of a foot operated spool valve which when pressed down the valve opens, and when released the valve closes. This foot operated spool valve is in the simplest form operated by the slide attendant. In this arrangement, the reservoir is filled and overflows into the slide when no attendant is present. The arangement, of course, can be reversed so that the valve is normally opened and closed by the operator pressing down on the foot operated spool valve. In such arrangement, the reservoir is filled only at the discretion of the slide attendant. As previously mentioned, sophisticated sensors and controls can be, if desired, utilized co-relating the quantity of water with the selected characteristics necessary with respect to the respective riders.

The embodiments of the invention in which an exclusive property or privilege is claimed ae defined as follows:

1. Improvement in water slide recreational installations of the type that include a water chute slide for the participants, a platform at an elevated start end of the slide, a landing pool at the bottom end of the slide and a water pumping system that delivers water to the elevated end of the slide for flow down the slide for the occupants thereof, said improvement comprising a generally vertically rising water tower reservoir at some location upstream from the end of the slide, means for directing water from a source of the same into said reservoir, valve means having a valved outlet communicating with a bottom portion of the water tower reservoir for discharging water from said reservoir into said chute and means controlling said valve for suddenly releasing a quantity of water at selected intervals from said reservoir into said chute to provide gushes of water that flow in spaced relation one after the other down said slide.

2. The improvement as defined in claim 1 including a sensor that detects the presence of an occupant on said slide and in response thereto allows said valve to open.

3. The improvement as defined in claim 2 wherein said sensor is downstream a selected distance from the beginning of the run of the slide.

4. The improvement as defined in claim 2 wherein said valve is biased to a normal open position and locked in its closed position and wherein said sensor deactivates said lock as the slide occupant passes the sensor.

5. The improvement as defined in claim 1 wherein said valve is biased to a normally open position by the water in said reservoir and including releasable lock means for holding the valve in a closed position.

6. The improvement as defined in claim 1 wherein said reservoir comprises a vessel having an upper overflow and a lower water outflow passage, a base, said vessel being mounted on said base and projecting upwardly therefrom, a water flow passage through said base communicating with the outflow passage from the vessel and discharging into the slide chute at the beginning of the run and wherein said valve is mounted on said base and controls the flow of water through the passage of the base.

7. Improvements in water slide recreational intallations of the type that include a water chute slide for the participants, of the type that include a water chute slide for the participants, a platform at an elevated start end of the slide, a landing pool at the bottom end of the slide and a water pumping system that delivers water to the elevated end of the slide for flow down the slide for the occupants thereof, said improvement comprising a water tower reservoir at some location upstream from the end of the slide, means for directing water from a source of the same into said reservoir, a valved outlet from said reservoir discharging into said chute, said valve being biased to a normally open position by the water in said reservoir and including releasably lock means for holding the valve in a closed position and wherein said valve comprises a pivotally mounted plate having a first and second faces respectively on opposite sides of the pivot axis, said faces preventing water flow from the reservoir in a valve closed position and wherein one of said first and second faces has a greater area than that of the other and means controlling said valve for suddenly releasing a quantity of water at selected intervals from said reservoir into said chute to provide gushes of water that flow in spaced apart relation one after the other down said slide.

8. The improvement as defined in claim 7 wherein the valve face having the smaller area is upstream of the other face with reference to water flow from the reservoir when the valve is open.

9. Apparatus in combination with a water slide recreational installation of the type that includes a water chute slide for the participants, a platform at an elevated start end of the slide, a landing pool at the bottom end of the slide and water flow down the slide for the occupants thereof, said apparatus comprising a base, a water reservoir mounted on and projecting upwardly from said base, passage means through said base communicating with said reservoir for directing water from said reservoir into said chute, a valve in said passage means selectively operable for suddenly releasing a quantity of water repeatedly at spaced intervals from said reservoir into said chute to provide intermittent gushes of water that flow in sequence at spaced intervals one after the other down said slide and means directing a flow of water into said reservoir to replenish water that has been released therefrom.

10. The combination as defined in claim 9 including means for actuating said valve from a location remote from the valve to selectively open and close the same.

11. The combination defined in claim 9 including adjustable support means for said base.

12. The combination as defined in claim 9 wherein said reservoir is an elongate, vertially disposed tube.

13. The combination as defined in claim 12 wherein said tube is detachably mounted on said base.

14. In combination a water slide recreational installation of the type having at least one water slide chute, a platform at an elevated start end of the slide, a landing pool at the bottom end of the slide, and means for releasing selected quantities of water to flow down the slide at selected spaced apart intervals, said means comprising a generally vertically rising reservoir at some location upstream from the end of the slide, means for supplying a flow of water to said slide, means for directing water from a source of the same into said reservoir, valve means having a valved outlet communicating with a bottom portion of the reservoir for discharging water form said reservoir into said chute and means controlling said valve for suddenly releasing a quantity of water at intervals from said reservoir into said chute to provide intermittent gushes of water that run in sequence one after the other in spaced apart relation down said slide.

15. In combination a water slide recreational installation of the type having at least one water slide chute, a platform at an elevated start end of the slide, a landing pool at the bottom end of the slide, and means for releasing selected quantities of water to flow down the slide at selected spaced apart intervals, said means comprising a reservoir at some location upstream from the end of the slide, said reservoir comprising a base having a water chamber therein, and a tube detachably mounted on said base and projecting upwardly therefrom, said tube communicating with said chamber in said base and wherein said valve is located in an outlet passage from said chamber, means supplying a flow of water to said slide, means for directing water form a source of the same into said reservoir, a valved outlet from said reservoir discharging into said chute and means controlling said valve for suddenly releasing a quantity of water at intervals from said reservoir into said chute to provide intermittent gushes of water that run in sequence one after the other in spaced apart relation down said slide.

16. A method of using a water slide system having a water slide with means for supplying a flow of water to the water slide, and storage reservoir means with valve means connected to a bottom portion of the storage reservoir means, said method enhancing the thrill of the ride down the water slide and improving the safety thereof, comprising the steps of providing a flow of water from the water supplying means, suddenly releasing a selected quantity of water to gush down the slide from the storage reservoir means at spaced apart intervals co-related to the frequency of the riders, each gush of water carrying therewith a rider, said spaced apart gushes of water maintaining such riders spaced relative to one another along the same slide and thus improving the safety for the riders on such slide.

17. A method of using a water slide system having a water slide with means for supplying a flow of water to the water slide, and storage reservoir means with valve means connected to a bottom portion of the storage reservoir means, said method improving the safety of the water slide and comprising the steps of repeatedly releasing from the storage reservoir means through the valve means in a gush a selected quantity of water down the slide behind each rider as they approach the beginning of the slide in sequence one after the other so as to carry therewith such riders at spaced apart positions therealong, said gushes of water carrying the respective slide riders maintaining such riders at spaced apart positions relative to one another throughout the run of the slide.

18. A water slide, comprising:

a slide run having an upper end portion and a lower end portion and along which slide run a first flow of water flows;

means for providing the first flow of water to the upper end portions; means storage reservoir means containing water and valve connected to a bottom portion of the storage reservoir means and being openable for suddenly releasing a quantity of water from the storage reservoir means to provide a second flow in the slide run in the form of an intermittent gush of water.

19. The water slide of claim 18, wherein said storage reservoir means includes a reservoir extending upwardly from the valve means and containing said water.

20. The water slide of claim 19, wherein said reservoir structure is an elongate, vertically disposed tube, and further including a base and means for detachably mounting said tube to said base.

21. Improvements in water slide recreational installations of the type that include a water chute slide for the participants, a platform at an elevated start end of the slide, a landing pool at the bottom end of the slide and a water pumping system that delivers water to the elevated end of the slide for flow down the slide for the occupants thereof, said improvement comprising a generally vertically rising water tower reservoir holding a quantity of water elevated with respect to and at a location upstream from the end of the slide, means for directing water from a source of the same into said reservoir, valve means having a valved outlet located below at least a portion of said generally vertically rising water tower reservoir and communicating with a bottom portion of the water tower reservoir for discharging water from said reservoir into said chute and means controlling said valve for suddenly releasing a quantity of water at selected intervals from said reservoir into said chute to provide gushes of water that flow in spaced relation one after the other down said slide.

* * * * *